United States Patent [19]

Escaravage

[11] Patent Number: 4,588,217

[45] Date of Patent: May 13, 1986

[54] LATCH IN PARTICULAR FOR A VEHICLE DOOR

[75] Inventor: Gerard Escaravage, Valentigney, France

[73] Assignee: Aciers et Outillage Peugeot, Audincourt, France

[21] Appl. No.: 566,848

[22] Filed: Dec. 29, 1983

[30] Foreign Application Priority Data

Jan. 6, 1983 [FR] France ..... 83 00133

[51] Int. Cl.[4] ..... E05C 3/26

[52] U.S. Cl. ..... 292/201; 74/2; 74/3.5; 292/216

[58] Field of Search ..... 292/201, 216, 722; 70/279; 74/2, 3.5

[56] References Cited

U.S. PATENT DOCUMENTS

| | | | |
|---|---|---|---|
| 2,881,021 | 4/1959 | Jacobson | 292/216 X |
| 3,347,584 | 10/1967 | Johnstone | 292/216 X |
| 3,359,767 | 12/1967 | Arlauskas et al. | 292/201 X |
| 3,917,330 | 11/1975 | Quantz | 292/216 |
| 4,125,008 | 11/1978 | Genest et al. | 70/279 |
| 4,258,945 | 3/1981 | Pouget | 292/201 X |
| 4,268,076 | 5/1981 | Itoi | 292/216 |
| 4,454,776 | 6/1984 | Barge | 292/201 X |

FOREIGN PATENT DOCUMENTS

| | | | |
|---|---|---|---|
| 58281 | 8/1982 | European Pat. Off. . | |
| 2920483 | 12/1980 | Fed. Rep. of Germany . | |
| 2372299 | 6/1978 | France . | |
| 2472651 | 7/1981 | France | 292/216 |

*Primary Examiner*—Robert L. Wolfe
*Assistant Examiner*—Russell W. Illich
*Attorney, Agent, or Firm*—Sughrue, Mion, Zinn, Macpeak and Seas

[57] ABSTRACT

The latch is of the type comprising a case 1 for the latch mechanism 6 and a keeper 4 which is movable relative to this case. The latch mechanism 6 comprises a forked bolt 7 for hooking onto the keeper, a shifting lever 16 for, in a first position thereof, retaining the bolt 7 in its hooking position and, in a second position thereof, releasing this bolt so as to permit the opening of the latch, and an electric actuating device which is adapted, by means of a motor 34 and a transmission 31, 33, to determine the two positions of said shifting lever 16. There are provided a device 29 for accumulating mechanical energy and loaded by the transmission 31, 33, a retaining device 22, 23 for retaining the shifting lever 16 in its first position and a striker device 28 adapted to retract the retaining device 22, 23 when the mechanical energy accumulating device 29 is controlled for releasing its mechanical energy and thus allow the movement of the shifting lever 16 to its second position for releasing the latch 7.

9 Claims, 13 Drawing Figures

LATCH IN PARTICULAR FOR A VEHICLE DOOR

The present invention relates to a latch, in particular for an automobile vehicle door, of the type comprising, on one hand, a case for the latch mechanism and, on the other hand, a keeper movable relative to said case, the latch mechanism comprising a forked bolt for hooking onto the keeper, a shifting lever for, in a first position, retaining the bolt in its hooking position and, in a second position, releasing said bolt so as to permit the opening of the latch, and an electric actuating device which is adapted to determine the two positions of said shifting lever by means of a motor and transmission means.

Latches having these characteristics are already known and disclosed in particular in several prior patent applications in the name of the Applicant (FR-No. 2 439 284, FR-No. 2 443 549, FR-No. 2 469 309), and also the patent application filed on Dec. 12, 1981 under the No. 81 23 916.

Altough the mechanisms of these latches operate in a satisfactory manner for a prolonged period of utilization, it would be desirable to prevent any risk of breakdown in the case where the electric actuating device is damaged or the source of power of this device is eliminated, for example in an accident. Now, most known latches do not permit the opening without the operation of the electric actuating device and consequently remain locked in the aforementioned cases.

An object of the invention is to provide a latch of the general type defined hereinbefore which may be easily opened without the use of the electric supply device, with the addition of a minimum number of component parts.

The invention therefore provides such a latch comprising mechanical energy accumulating means loaded by said transmission means, retaining means for said shifting lever in its first position and a striker element for retracting the retaining means when the energy storing means are controlled to release their mechanical energy and thus allow the movement of the shifting lever to its second position for releasing the bolt.

A latch having the aforementioned features does not have a direct coupling between the electric actuating device and the shifting lever so that the latter can be released by an action other than that brought about by this device.

In a particular advantageous construction of the latch according to the invention, the means for retaining the shifting lever itself constitutes a safety lever capable of being shifted manually for releasing the shifting lever in the event that a breakdown occurs in the electric actuating device.

Further features and advantages of the invention will be apparent from the following description, which is given solely by way of example with reference to the accompanying drawings, in which.

Figure 1:
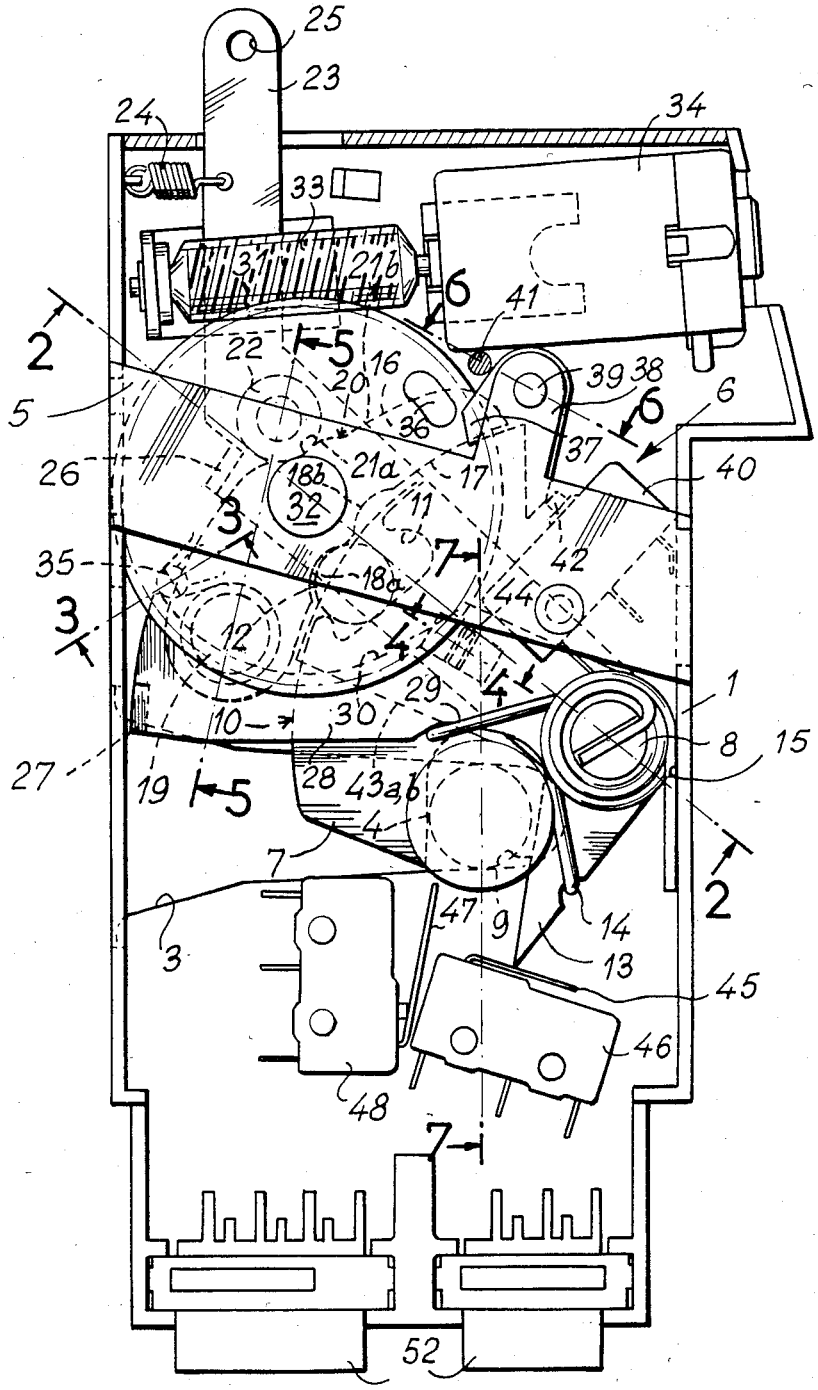
FIG. 1 is a plan view of the latch according to the invention, its case being shown without a cover.

In the embodiment shown in the Figures, the latch according to the invention comprises a case 1 closed by a cover 2 and having a lateral entrance aperture 3 for a keeper 4. By way of example, the latter may be mounted on the upright of the body of the vehicle, the case 1 being secured to the edge of the door of the latter, in the conventional way in automobile construction.

A strip 5 is rigid with the case and interconnects two opposed walls of the case, this strip supporting some component parts of the latch mechanism 6 which will now be described in detail.

This latch mechanism 6 comprises first of all a bolt 7 pivotally mounted on a pin 8 which is riveted to the bottom of the case 1 in a position perpendicular to said bottom. This bolt has a notch 9 which imparts thereto a forked shape and in which is adapted to be hooked the keeper 4 when the latch is closed. The bolt also has an arcuate edge 10 in which is formed a cavity 11 for receiving a locking element 12 which is, in the presently-described embodiment, in the form of a roller. On the opposite side, the bolt also has a heel 13 the purpose of which will be clear hereinafter and to which is hooked a return spring 14 which bears against the lateral wall of the case at 15.

The bolt 7 cooperates with a shifting lever 16 which has an elongated shape and is sightly curved so as to match by one of its longitudinal sides 17 the shape of the edge 10 of the bolt 7. This side 17 of the shifting lever 16 has two juxtaposed notches 18*a* and 18*b* in which the roller 12 can be stopped for closing the latch. The shifting lever 16 is pivotally mounted on the case by a pin 19. The edge of the shifting lever 16 opposed to the edge 17 constitutes a cam 20 having two levels 21*a* and 21*b* with which cooperates a roller 22 rotatively mounted on a lever 23, the assembly constituting means for retaining the shifting lever 16.

The lever 23 has roughly the shape of a V one branch of which is pivotally mounted on the pin 8 and extends below the bolt 7 while the other branch extends outside the case 1. This lever is biased to a position of rest by a return spring 24, in which position the roller 22 is in contact with the first level 21*a* of the cam 20 of the lever 16. At the outer end, the lever 23 has a hooking orifice 25 in which can be engaged a hook of a linkage (not shown) for providing the safety opening of the latch.

The safety lever 23 has at the intersection of its two branches, a tab 26 folded at 90° relative to its general plane. This tab constitutes an anvil adapted to cooperate with a striker tab 27 of a striker lever 28 which is pivotally mounted on the pin 8 and is pivotable about this pin in a plane parallel to the plane in which the bolt 7 and the shifting lever 16 respectively extend.

Figure 1A:
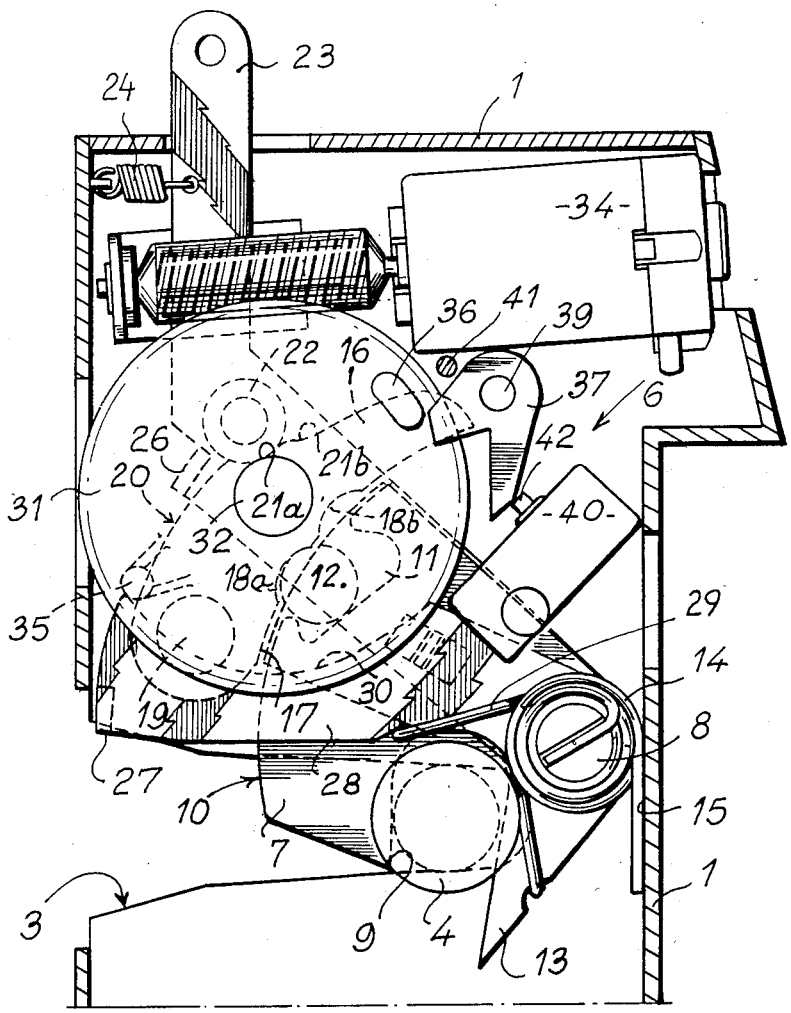
FIG. 1A is a partial view of this latch which is similar to FIG. 1, some component parts of which have been removed for reasons of clarity.

The striker lever cooperates with a spring 29 for accumulating energy which is wound round the pin 8, as the spring 14, and which biases this lever in the clockwise direction as viewed in FIG. 1A.

The lever 28 has a curved edge 30 constituting a cam.

Figure 2:
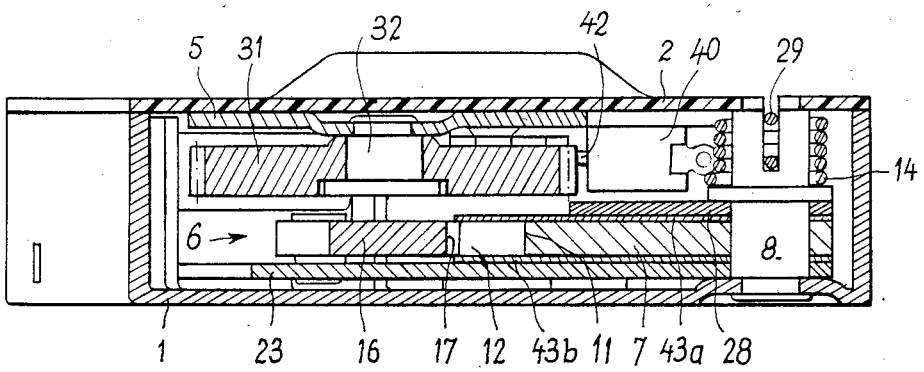
FIGS. 2 to 7 are sectional views taken respectively along lines 2—2, 3—3, 4—4, 5—5, 6—6 and 7—7 of FIG. 1.
Figure 3:
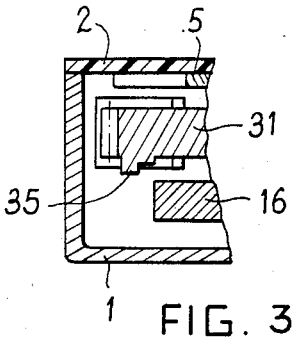

Above the assembly just described, (as viewed in FIGS. 1 and 1A), the latch mechanism 6 also includes a transmission wheel 31 provided with outer toothing and rotatively mounted on a pin 32 fixed in the strip 5 (FIGS. 1 and 2). This wheel is meshed with a worm 33 keyed on the shaft of an electric motor 34 fixed in the case. Extending from one of the sides of the wheel 31 (ie. the lower side as viewed in FIG. 1A), is a driving stud 35, the other side of the wheel being provided with a haricot beanshaped projection 36, the two projections 35 and 36 being provided roughly in diametrically opposed positions.

Figure 6:
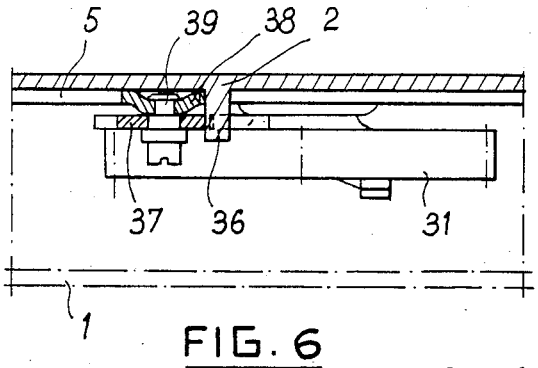
Figure 7:
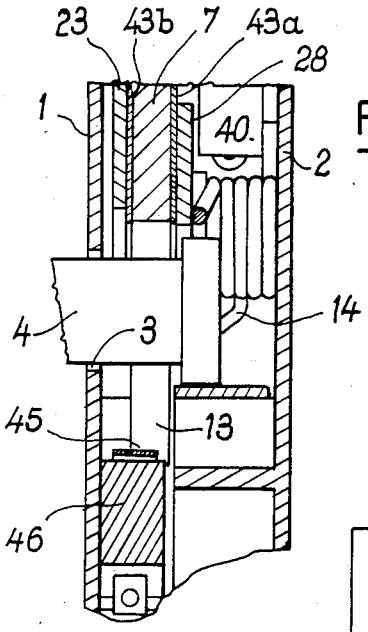
Figure 8:
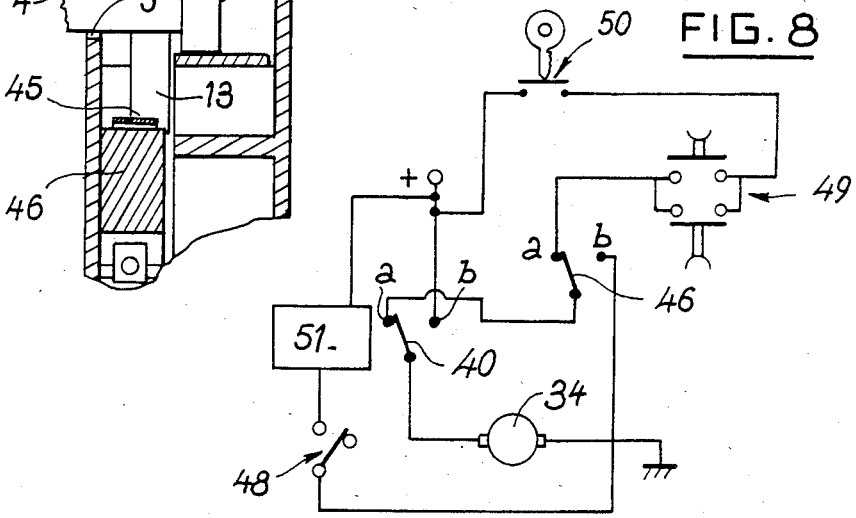
FIG. 8 is an electric diagram illustrating the control of latch according to the invention.

The driving stud 35 cooperates with the cam 30 of the striker lever 28 and the projection 36 is adapted to cooperate with a V-shaped control lever 37 pivotally mounted on a lateral tab 38 of the strip 5 by means of a pin 39 which is adapted to control an electric switch 40 fixed in the box (FIGS. 1A, 6 and 8). The lever 37 is normally biased against an abutment 41 rigid with the case by an actuating push-member 42 of the switch 40, this push-member being resiliently biased outwardly of the housing of the switch.

Figure 4:
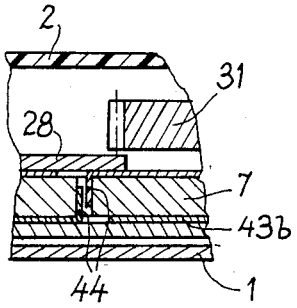
Figure 5:
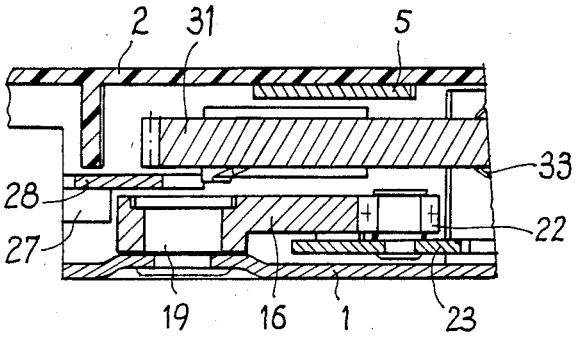

The bolt 7 is associated with two maintaining side walls 43*a* and 43*b*, which are disposed on each side of the bolt 7 and are pivotally mounted on the pin 8, as the bolt 7, and rendered rigid with the latter by cut-out and formed-over tabs 44 (see, in particular, FIG. 4). These side walls are adapted to close laterally the cavity 11 in which the roller 12 is disposed.

FIG. 1 shows that the heel 13 of the bolt 7 cooperates with an actuating strip 45 of a second switch 46 and with a strip 47 of a third switch 48, the two switches being fixed in the case and being capable of being actuated when the bolt 7 moves from its closing position to its opening position and vice-versa.

As can be seen in FIG. 8, the switch 40 has its moving contact connected to one of the terminals of the motor 34 whose other terminal is connected to earth. Further, one of the fixed contacts a of the switch 40 is connected to the moving contact of the switch 46 while the fixed contact b of the switch 40 is connected to the positive terminal of the supply. One of the fixed terminals of the switch 46 is connected to an assembly 49 of push-buttons provided respectively outside and inside the door provided with this latch, this assembly being connected to a latch contact 50 also provided on this door and adapted to prevent or allow the operation of the latch. The opposite side of the latch contact 50 is connected to the positive terminal of the supply source. The fixed contact b of the switch 46 is earthed.

The switch 48 is connected between earth and a device 51 which may be controlled by this switch. It may concern, for example, an indicator light of the dashboard, a mechanism for automatically unlocking or locking safety belts or any other like control device capable of being coupled with the operation of the door latch in the vehicle.

The latch is completed by electric sockets 52 which are adapted to connect it to the electric circuit of the vehicle.

This latch operates in the following manner (FIGS. 9A to 9D):

In the present description, the detailed operation of the bolt 7, the roller 12 and the shifting lever 16 will not be repeated, since this question was dealt with in detail in the aforementioned patent application No. 81 23 916.

However, in contrast to the construction of the latch of the last-mentioned patent application, the latch according to the invention has retaining means which are in the form of the safety lever 23 and the roller 22.

Figure 9A:
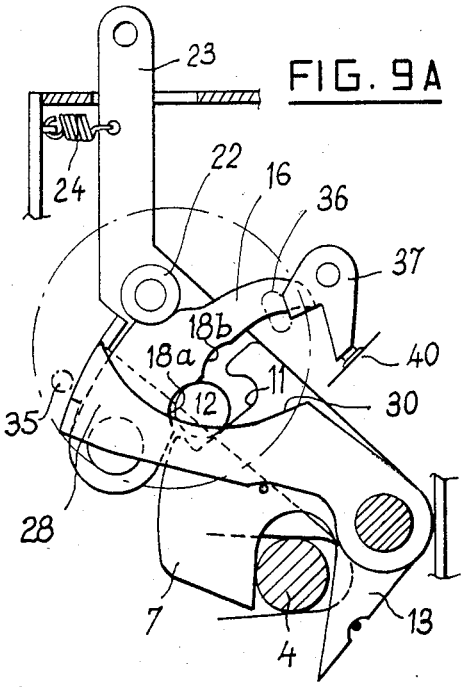
FIGS. 9*a* to 9*d* are simplified diagrams of the operation of the latch according to the invention.

FIG. 9A shows that, when the latch is closed (the keeper engaged in the notch of the bolt), and all the component parts are at rest, the roller 22 bears against the upper level 21*a* of the cam 20 of the shifting lever 16. Under these conditions, this lever traps the locking roller 12 in the cavity 11 of the bolt 7, either in the notch 18*a* (closure termed a "second stage" closure) or in the notch 18*b* (closure termed "first stage" closure). The control lever 37 of the switch 40 is maintained in its active position by the projection 36 of the wheel 31 in oposition to the action of the spring (not seen in the drawing), which normally biases the push-member 42 of the switch 40 outwardly of the housing of the latter. Consequently, the moving contact of this switch is urged against its fixed contact a so that the circuit of the motor 34 is broken.

When the user depresses one of the push-buttons of the assembly 49, the motor 34 is supplied with current through the switches 46 and 40, provided of course that the contact of the switch 50 is closed.

The motor 34 drives the wheel 31 in rotation and as soon as the projection 36 leaves the lever 37, the latter pivots under the action of the push-member 42 of the switch 40 whose moving contact swings to its opposed position relative to that shown in FIG. 8. This switch then assumes the function of the assembly 49 of the push-buttons and ensures the self-supply of the motor 34.

As the wheel 31 continues to rotate, the driving stud 35 comes into contact with the cam 30 of the striker lever so that the latter pivots about the pin 8 and stresses the spring 29.

Figure 9B:
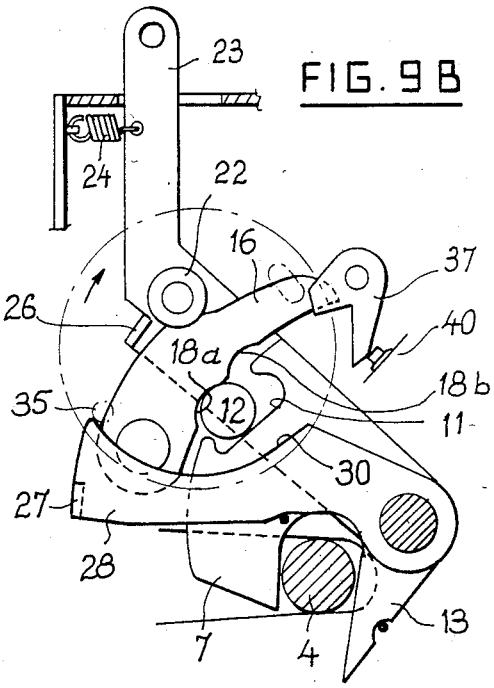
Figure 9C:
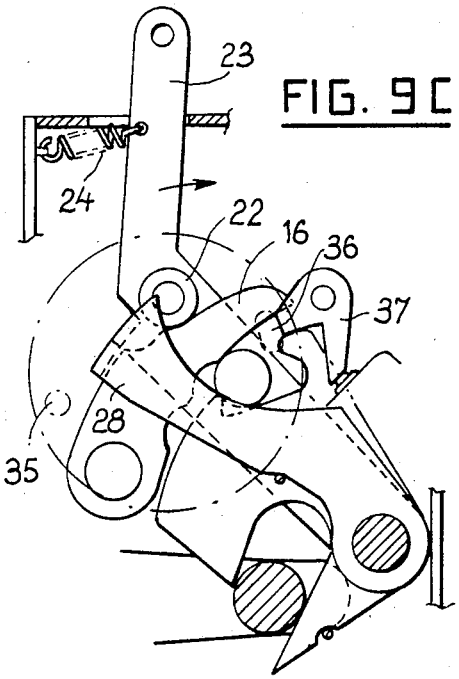
Figure 9D:
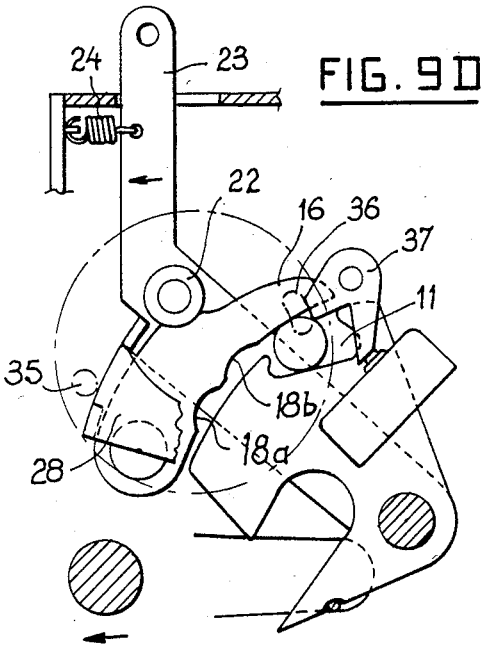

When the wheel reaches the position shown in FIG. 9B, the bolt 7, the roller 12 and the shifting lever 16 are still in the same position, only the striker lever and the control lever 37 having been shifted. As soon as the driving stud 35 leaves the cam 30, the energy accumulated in the spring 29 as a result of the pivoting of the striker lever, is released an this lever is consequently thrown in the direction of the lever 23 until the striker tab 27 comes into contact with the anvil 26, the impact causing the pivoting of the lever 23 about the pin 8. Consequently, the roller 22 leaves the upper level of the cam 20 so that the shifting lever 16 can rotate about the pivot pin 19 away from the bolt 7, thus unlocking the latch, the roller 12 being disengaged from the cavity 18*a* (or 18*b*). As the keeper 4 is biased in the direction for opening the latch by the sealing elements of the door, it causes the pivoting of the bolt 7 and the latch opens (FIG. 9C). Meanwhile, the wheel 31 has continued to rotate and is finally stopped as soon as the projection 36 again bears against the lever 37 toward its initial position and pivots the moving contact of the switch 40 to the fixed contact a. Also meanwhile, the lever 23 is returned to its initial position by the spring 24 and the shifting lever 16 is placed in its initial position while the switch 46 operates to short the armature winding of the motor 34 and immediately stop this motor.

If, at any moment, in the operation just described, the supply of the motor 34 disappears or a breakdown occurs in this motor, the assembly stops, but the latch can nonetheless be opened manually by action on the lever 23 in opposition to the action of the spring 24 for releasing the lever 16 which can then pivot about its pivot pin 19 and disengage the roller 12. Of course, this is also true when the latch is completely closed as shown in FIG. 9A, and there is a breakdown in the current in the electric circuit of the vehicle. It should be mentioned that the striker lever, after having performed its fonction and shifted the lever 23, returns to its initial position shown in FIG. 9A.

When the latch is closed, the bolt 7 and the locking means 12 are returned to their position shown in FIG. 9A, under the action of the keeper 4 and the motor 34 does not intervene in this stage of operation.

What is claimed is:

1. A latch in particular for a motor vehicle door, said latch comprising a latch mechanism, a case for said mechanism and a keeper movable relative to said case, the latch mechanism comprising a forked bolt for hooking onto said keeper in a hooking position of said bolt, a shifting lever having a first position for retaining the bolt in said hooking position and a second position for releasing said bolt so as to permit the opening of the latch, and an electric actuating device including an electric motor and transmission means and operative to bring said shifting lever to said two positions thereof, said latch futher comprising mechanical energy accumulating means connected to said transmission means for being loaded by said transmission means, retaining means for retaining said shifting lever in said first position, and a striker element for retracting said retaining means when said mechanical energy accumulating means are controlled to release their mechanical energy and thus allow the movement of the shifting lever to said second position for releasing the bolt.

2. A latch according to claim 1, wherein said retaining means for said shifting lever comprise means permitting the manual retraction thereof in the event of a fault in the operation of said electric actuating device.

3. A latch according to claim 1, wherein said mechanical energy accumulating means include a spring.

4. A latch according to claim 3, wherein said spring is connected to said transmission means through said striker element.

5. A latch according to claim 4, wherein said transmission means comprise a wheel connected to be driven in rotation by said motor and having a periphery and a thrust element is mounted on said wheel adjacent its periphery and said striker element includes a cam cooperative with said thrust element so that said striker element is shifted in opposition to the action of said spring when said wheel is driven in rotation.

6. A latch according to claim 1, wherein a cam is provided on said shifting lever and said retaining means comprise a pivotal lever and a roller which is carried by said pivotal lever and is cooperative with said cam provided on said shifting lever, said cam having two levels with which levels said roller carried by said pivotal lever respectively engages in said two positions of said shifting lever.

7. A latch according to claim 5, wherein said retaining means comprise a pivotal lever and a roller which is carried by said pivotal lever and is cooperative with said cam provided on said shifting lever, said cam having two levels with which levels said roller carried by said pivotal lever respectively engagges in said two positions of said shifting lever, said striker element and said retaining means being pivotally mounted on a common pin rigid with said case.

8. A latch according to claim 7, wherein said bolt and said shifting lever have conjugate arcuate edges in which edges are formed recesses and a locking element is trappable in said recesses in the locked position of the latch, it being possible to unlock the latch upon the retraction of said retaining means by moving said conjugate edges away from each other, said bolt being pivotally mounted on said common pin.

9. A latch according to claim 6, wherein said striker element has a first tab which extends substantially at 90° to a general plane of said striker element and a conjugate second tab is provided on said retaining means and extends at substantially 90° to a general plane of said retaining means, said first tab being cooperative with said second tab.

* * * * *